US011359894B2

(12) United States Patent
Nefzer et al.

(10) Patent No.: US 11,359,894 B2
(45) Date of Patent: Jun. 14, 2022

(54) BULLET HIT SQUIB AND METHOD FOR MANUFACTURING

(71) Applicant: Nefzer Special Effects GmbH, Schwäbisch-Hall (DE)

(72) Inventors: Gerd Nefzer, Schwäbisch Hall (DE); Ulrich Nefzer, Michendorf (DE); Marcus Preußing, Potsdam (DE)

(73) Assignee: NEFZER SPECIAL EFFECTS GMBH, Schwäbisch-Hall (DE)

( * ) Notice: Subject to any disclaimer, the term of this patent is extended or adjusted under 35 U.S.C. 154(b) by 0 days.

(21) Appl. No.: 16/903,590

(22) Filed: Jun. 17, 2020

(65) Prior Publication Data

US 2020/0400410 A1 Dec. 24, 2020

(30) Foreign Application Priority Data

Jun. 18, 2019 (DE) ..... 10 2019 116 464.8

(51) Int. Cl.

| | |
|---|---|
| ***F42B 3/14*** | (2006.01) |
| ***F42B 3/11*** | (2006.01) |
| ***F42B 4/02*** | (2006.01) |
| ***F42C 19/12*** | (2006.01) |

(52) U.S. Cl.

CPC ..... *F42B 3/14* (2013.01); *F42B 3/11* (2013.01); *F42B 4/02* (2013.01); *F42C 19/12* (2013.01)

(58) Field of Classification Search

CPC .... F42B 3/11; F42B 3/128; F42B 3/14; F42B 4/02; F42C 19/12

USPC ..... 102/335, 346, 355, 357, 202.5, 202.7, 102/202.8, 202.11

See application file for complete search history.

(56) References Cited

U.S. PATENT DOCUMENTS

| | | | | |
|---|---|---|---|---|
| 459,321 | A * | 9/1891 | Ward | F42B 3/14 102/202.8 |
| 2,086,527 | A * | 7/1937 | Aughey | F42B 3/18 102/202.4 |
| 2,086,532 | A * | 7/1937 | Burrows | F42B 3/18 102/202.4 |
| 2,185,370 | A | 1/1940 | Burrows et al. | |
| 2,525,397 | A | 10/1950 | Cairns et al. | |
| 2,761,386 | A | 9/1956 | Zebree | |
| 3,132,586 | A * | 5/1964 | Scharwächter | F42B 3/124 361/248 |
| 3,186,341 | A * | 6/1965 | Bjorkland | F42C 19/0815 102/275.9 |
| 3,450,045 | A | 6/1969 | Zedalis | |

(Continued)

FOREIGN PATENT DOCUMENTS

DE 69908372 T2 4/2004

OTHER PUBLICATIONS

Kohler, Josef et al: Explosive—Stoffe—Wily—VCH—ISBN 3-527-28864-3, English abstract.

*Primary Examiner* — Bret Hayes

(74) *Attorney, Agent, or Firm* — Schmeiser, Olsen & Watts, LLP

(57) ABSTRACT

Provided is a bullet hit squib including: an electrical connection line; a glow wire connected to the electrical connection line; and a primary explosive charge by which an active substance is formed which can be ignited by the glow wire. The primary explosive charge is formed by a primary explosive which is free of heavy metals and contains silver azide. A method for producing a bullet hit squib is also provided.

10 Claims, 2 Drawing Sheets

(56) References Cited

U.S. PATENT DOCUMENTS

Figure 1:
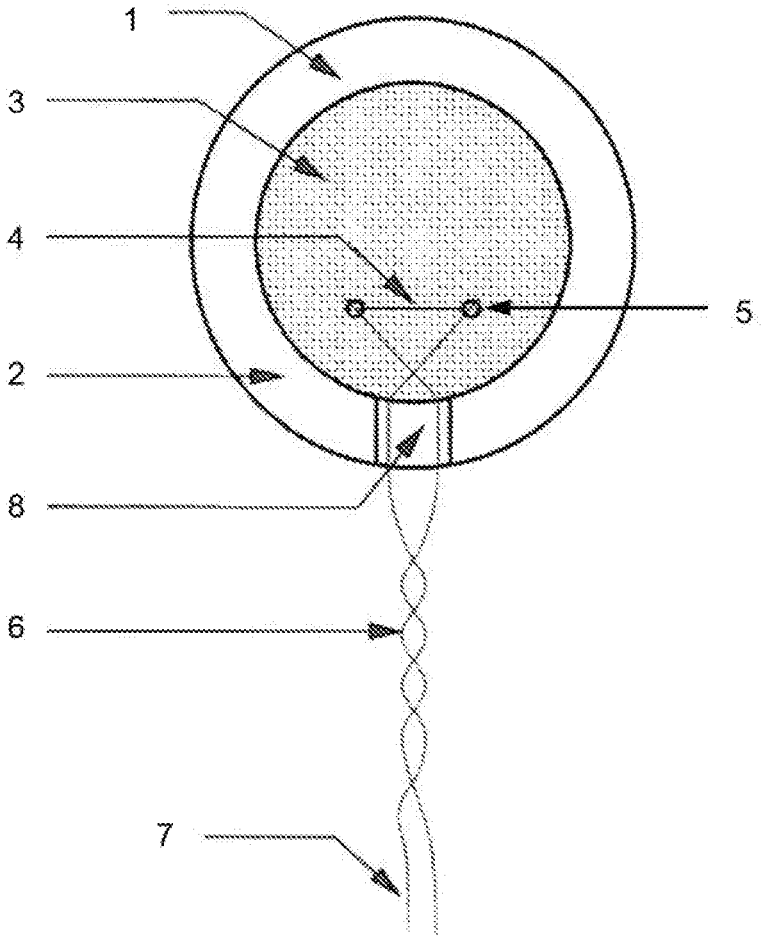

| | | | | | |
|---|---|---|---|---|---|
| 3,763,783 | A * | 10/1973 | Thomas | F42B 3/124 | 149/24 |
| 3,793,920 | A * | 2/1974 | Sheran | F42B 3/14 | 86/1.1 |
| 4,527,481 | A * | 7/1985 | Evans | F42C 19/10 | 102/204 |
| 4,819,560 | A * | 4/1989 | Patz | F42B 3/13 | 102/202.5 |
| 5,709,724 | A * | 1/1998 | Naugler | C03C 27/02 | 65/59.4 |
| 6,149,745 | A * | 11/2000 | Matsuda | C06B 23/001 | 149/35 |
| 6,651,563 | B2 * | 11/2003 | Faber | C06B 45/14 | 102/202 |
| 9,533,237 | B2 * | 1/2017 | Testa | A63J 5/04 | |
| 2002/0117070 | A1 * | 8/2002 | Hatzl | F42B 3/124 | 102/202.5 |
| 2016/0238354 | A1 | 8/2016 | Hinkofer et al. | | |

* cited by examiner

BULLET HIT SQUIB AND METHOD FOR MANUFACTURING

CROSS-REFERENCE TO RELATED APPLICATIONS

This application claims priority to German Application No. 10 2019 116 464.8, having a filing date of Jun. 18, 2019, the entire contents both of which are hereby incorporated by reference.

FIELD OF TECHNOLOGY

The following relates to a bullet hit squib and to a method for producing a bullet hit squib.

BACKGROUND

Such bullet hit squibs are used in conjunction with film, television or theater recordings to depict projectile impacts in a scenic manner or to drive mechanical special effects equipment pyrotechnically. A bullet hit squib is disclosed, for example, in DE 101 64 381 B4. The known bullet hit squib is characterized by an initial explosive, which is an atoxic metal salt of mono- and/or hydroxyazobenzene. Furthermore, the known bullet hit squib has a passivator and the tetrazole compounds of highly nitrated, aromatic compounds and an atoxic metal salt of dinitrobenzofuroxane.

SUMMARY

An aspect relates to a bullet hit squib and a method for the production thereof, by which the provision of a low-pollutant bullet hit squib having the necessary explosive force is possible in a simple and efficient manner.

According to one aspect, a bullet hit squib is provided which has an electrical connection line and a glow wire which is connected to the electrical connection line. Furthermore, the bullet hit squib has a primary explosive charge by which an active substance is formed which can be ignited by the glow wire. The primary explosive charge is formed by a primary explosive which is free of heavy metals and contains silver azide.

According to a further aspect, a method for producing a bullet hit squib is provided, in which method an electrical connection line is provided and connected to a glow wire. Furthermore, charging with a primary explosive charge is provided, which forms an active substance which can be ignited by the glow wire. The primary explosive charge is formed by a primary explosive which is free of heavy metals and contains silver azide.

By using silver azide for the primary explosive of the primary explosive charge, it is possible to form the bullet hit squib without heavy metals, whereby the primary explosive configured in this way provides a sufficient explosive effect. Fewer visible clouds are produced. A faster, shorter detonation flash was observed, which allows a "better picture" for film and television recording (more realistic visual representation of the shot). The detonation pressure is higher due to the use of silver azide (with the same design).

Silver azide can be produced in different ways, for example using sodium azide ($NaN_3$) and silver nitrate ($AgNO_3$), which are each dissolved in water. Silver azide can then be obtained by a precipitation reaction. This is followed by washing. The silver azide can be activated by drying the moist material obtained in this way.

The primary explosive charge can consist of the primary explosive containing silver azide. In this embodiment the primary explosive charge is formed from the primary explosive containing the silver azide.

The primary explosive can consist of silver azide. In this case, only silver azide is used as the primary explosive.

The primary explosive charge in the bullet hit squib can consist of a main primary explosive charge and can be free of an initial primary explosive charge. In this embodiment, the primary explosive charge contains no further primary explosives in addition to the primary explosive charge which forms the main primary explosive charge. Savings are made on an initial primary explosive charge.

The glow wire can have an anti-corrosion coating at least in the region of a wire portion which is in contact with the primary explosive charge. By using the corrosion coating, the wire portion of the glow wire is protected against corrosion, in particular against a corrosive effect of the primary explosive charge. This assists the functional reliability of the bullet hit squib.

The anti-corrosion coating of the bullet hit squib can be formed or produced by an adhesive which is applied to the glow wire in the region of the wire portion. The adhesive applied as a corrosion coating can be the same adhesive by which components are adhesively bonded to one another, in particular glued, during the production of the bullet hit squib. The anti-corrosion coating can then be produced by applying the glue or a paste.

The bullet hit squib can have a carrier with which a receptacle for the glow wire and the primary explosive charge is provided. At least in portions, the glow wire and the primary explosive charge are arranged on the carrier. In this case, the carrier can be adhesively connected (glued) to the glow wire and/or the primary explosive charge by an adhesive. The carrier can be, for example, a disk, a ring or a sleeve, which can have a cylindrical shape. The ring can be provided with a bottom, such that a receiving space for the glow wire and the primary explosive charge is provided within the ring. Comparably, the glow wire and the primary explosive charge can be received at least partially in the interior of the sleeve. The primary explosive charge on the carrier can be covered by a cover which is, for example, glued on. As a result, in one embodiment, the primary explosive charge can be arranged in a receiving space which is surrounded on several sides and which can be substantially closed.

Carrier portions of the carrier which are in contact with the primary explosive charge can be made, at least in portions, of a material that absorbs moisture from the primary explosive charge. This embodiment is particularly advantageous when the primary explosive charge is originally produced as a moist material and applied to the carrier. The carrier portion then serves to absorb the moisture from the moist material and to release it into the environment. The carrier can consist substantially completely of the moisture-absorbing and dissipating material. The material of the carrier portion can be, for example, a paper or cardboard material. If a cover is provided for the primary explosive charge on the carrier, this cover can also be made of the moisture-absorbing material and thus can contribute to drying the primary explosive charge.

In conjunction with the method for producing the bullet hit squib, the explanations given above apply, mutatis mutandis, to embodiments. Furthermore, the following explanations in particular can be provided.

The primary explosive charge can be applied as a moist material, and the moist material can then be dried to activate the active substance.

In embodiments of the method, an anti-corrosion coating can be applied to the glow wire at least in the region of a wire portion which comes into contact with the primary explosive charge before charging. The anti-corrosion coating can be applied and then dried. The coating can consist of an adhesive, for example glue or paste.

In embodiments of the method, a receptacle of a carrier which receives the glow wire can be charged with the primary explosive charge.

Carrier portions of the carrier which come into contact with the primary explosive charge during charging can absorb moisture from the primary explosive charge and can thereby contribute to the drying thereof.

BRIEF DESCRIPTION

Figure 2:
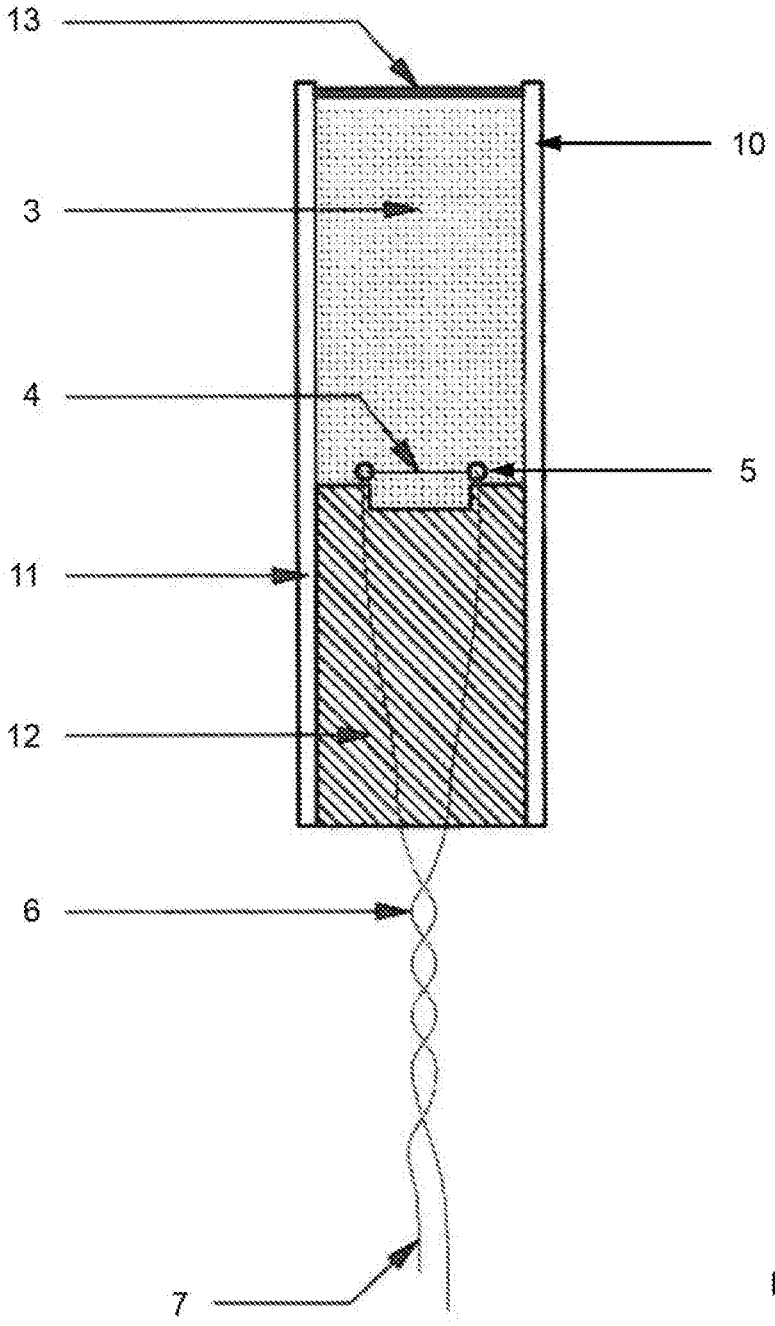

Some of the embodiments will be described in detail, with references to the following Figures, wherein like designations denote like members, wherein:

FIG. 1 shows a schematic illustration of a bullet hit squib, in which a carrier is designed so as to have a ring; and FIG. 2 shows a schematic illustration of another bullet hit squib, in which a carrier is formed so as to have a sleeve.

DETAILED DESCRIPTION

FIG. 1 shows a schematic illustration of a bullet hit squib 1, in which a ring 2 forms a carrier on which a primary explosive charge 3 forming an active substance is arranged. The primary explosive charge 3 also surrounds a glow wire 4 which, in the region of contact points 5, is connected to connecting wires 6 which are twisted in a central portion and have separated ends 7. In a portion 8 of the ring 2, an adhesive connection is made between the connecting wires 6 and the ring 2.

An electrical voltage can be supplied via the separated ends 7 in order to cause the glow wire 4 to glow, such that the primary explosive charge 3 of the bullet hit squib 1 is ignited.

In order to simplify the illustration, a cover which can grip the ring 2 and the primary explosive charge 3 together with the glow wire 4 accommodated therein, is not shown in FIG. 1. The ring 2 and the cover (not shown) can consist of a material which absorbs moisture from the primary explosive charge 3 and releases it to the outside, for example a paper or cardboard material. This makes it possible first of all to apply the primary explosive charge 3 as a moist material, optionally to press it in, and then to dry it for activation, this drying process being promoted by the material carrying moisture away from the primary explosive charge 3. The various embodiments can be dried in air and/or in a drying oven.

FIG. 2 shows a schematic illustration of a further bullet hit squib 10, in which a sleeve 11 forms a carrier in which the primary explosive charge 3 together with the glow wire 4 embedded therein is arranged. The same reference numerals as in FIG. 1 are used in FIG. 2 for the same features.

The glow wire 4 is connected via the contact points 5 to the connecting lines 6, the separated ends 7 of which serve for connection to electrical power. Furthermore, in the embodiment in FIG. 2, an insulating plug 12 is provided, which is also arranged in the cylindrical sleeve 11. The connecting lines 6 run through the insulating plug 12.

The sleeve 11 is made of a material by which moisture can be absorbed from the primary explosive charge 3 and dissipated to the outside, which assists the drying of the primary explosive charge 3 after application as a moist material. For example, the sleeve 11 can consist of a cardboard or paper material.

The further bullet hit squib in FIG. 2 also has a cover 13, which can also be made of the moisture-dissipating material.

The different embodiments of the bullet hit squib 1, 10 have the common feature that the primary explosive charge 3 forming the active substance contains silver azide. Sodium azide ($NaN_3$) and silver nitrate ($AgNO_3$) can be used as raw materials for the production of silver azide, for example by dissolving the raw materials in water. By using a precipitation reaction, a moist primary explosive is produced which is inactive in the water. The silver azide can then be filtered out, as a result of which a moist material is provided which can be applied to the corresponding carrier of the bullet hit squib 1, 10. This is followed by drying in order to activate the primary explosive.

During production of the particular bullet hit squib 1, 10, before the application of the primary explosive charge 3 (for example as a moist material) the glow wire 4 can be provided with an anti-corrosion coating at least in portions, in order thus to prevent the glow wire 4 from corroding and in this way to maintain the functionality of the bullet hit squib 1, 10 even after prolonged storage. In one embodiment, the anti-corrosion coating can be formed by an adhesive material, for example paste or glue, which is then also used for the adhesive connection of other components of the bullet hit squib 1, 10, for example the cover 13 being glued on.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

The invention claimed is:

1. A bullet hit squib, comprising:

an electrical connection line;

a glow wire which is connected to the electrical connection line; and a primary explosive charge, which, when dried, results in an active substance that can be ignited by the glow wire;

a carrier having a receptacle for the glow wire and the primary explosive charge, wherein carrier portions of the carrier which are in contact with the primary explosive charge are made, at least in portions, of a material that absorbs moisture from the primary explosive charge;

wherein the primary explosive charge includes a main primary explosive charge which is formed by a primary explosive containing silver azide and is free of an initial primary explosive charge.

2. The bullet hit squib according to claim 1, wherein the primary explosive charge consists of the primary explosive containing silver azide.

3. The bullet hit squib according to claim 1, wherein the primary explosive consists of silver azide.

4. The bullet hit squib according to claim 1, wherein the glow wire has an anti-corrosion coating at least in the region of a wire portion which is in contact with the primary explosive charge.

5. The bullet hit squib according to claim 4, wherein the anti-corrosion coating is formed by an adhesive which is applied to the glow wire in the region of the wire portion.

6. A method for producing a bullet hit squib, comprising:

providing an electrical connection line;

connecting a glow wire to the electrical connection line; and charging with a primary explosive charge which, when dried, results in an active substance that can be ignited by the glow wire;

wherein the primary explosive charge includes a main primary explosive charge which is formed by a primary explosive containing silver azide and is free of an initial primary explosive charge;

wherein a receptacle of a carrier which receives the glow wire is charged with the primary explosive charge and wherein carrier portions of the carrier which come into contact with the primary explosive charge during charging absorb moisture from the primary explosive charge.

7. The method according to claim 6, wherein the primary explosive charge is applied as a moist material, and the moist material is then dried resulting in the active sub stance.

8. The method according to claim 7, wherein the carrier portions contribute to drying of the moist material.

9. The method according to claim 6, wherein an anti-corrosion coating is applied to the glow wire at least in a region of a portion of the glow wire which comes into contact with the primary explosive charge before charging.

10. The method according to claim 6, wherein a receptacle of a carrier which receives the glow wire is charged with the primary explosive charge.

* * * * *